United States Patent [19]

Mattson

[11] 3,989,252

[45] Nov. 2, 1976

[54] GAME USING A SPIRAL TUBE AND A ROULETTE WHEEL

[75] Inventor: Alvin D. Mattson, La Puente, Calif.

[73] Assignee: The Raymond Lee Organization, Inc., New York, N.Y.

[22] Filed: Aug. 11, 1975

[21] Appl. No.: 603,750

[52] U.S. Cl. ..... 273/138 R; 46/43; 273/120 R

[51] Int. Cl.[2] ..... A63F 5/04; A63F 7/10

[58] Field of Search..... 273/142 D, 142 E, 142 F, 273/142 G, 120 R, 120 A, 86 C, 109, 138 R, 138 A, 145 B; 46/43; D34/5 KK, 5 LL, 15 K

[56] References Cited

UNITED STATES PATENTS

| | | | |
|---|---|---|---|
| 260,815 | 7/1882 | Wilcox | 273/120 R |
| 293,898 | 2/1884 | Martin | 273/120 R |
| 326,078 | 9/1885 | Wood | 273/120 R |
| 346,092 | 7/1886 | Croswell | 273/120 R |
| 407,713 | 7/1889 | Wilson | 273/120 R |
| 424,260 | 3/1890 | Bender | 273/120 R |
| 675,478 | 6/1901 | Harkrider | 273/120 R |
| 1,296,129 | 3/1919 | Siegel | 273/120 R |
| 1,769,327 | 7/1930 | Wood | 46/43 |
| 2,528,250 | 10/1950 | Slutzker | 46/43 X |
| 2,634,128 | 4/1953 | Reed | 273/120 R |
| 2,729,914 | 1/1956 | Cook | 46/43 |

FOREIGN PATENTS OR APPLICATIONS

| | | | |
|---|---|---|---|
| 195,066 | 2/1908 | Germany | 273/120 R |
| 596,792 | 5/1934 | Germany | 273/142 E |
| 812,409 | 8/1951 | Germany | 273/120 R |
| 170,483 | 7/1934 | Switzerland | 273/120 R |
| 268,191 | 5/1950 | Switzerland | 273/120 R |
| 456,153 | 11/1936 | United Kingdom | 273/142 E |

*Primary Examiner*—Anton O. Oechsle
*Assistant Examiner*—Arnold W. Kramer
*Attorney, Agent, or Firm*—Stephen Wyden

[57] ABSTRACT

A funnel mounted on a case and connected to a tube spirally down through the case and exiting over a roulette wheel where a steel ball dropped through the funnel may land scoring a value, 100 winning, and with a slot marked 100 on the wheel to provide a sudden death game ending.

3 Claims, 5 Drawing Figures

GAME USING A SPIRAL TUBE AND A ROULETTE WHEEL

I have invented a new and novel game using a spiral tube and a roulette wheel. By taking turns dropping a steel ball in a funnel connected to a spiral of plastic tubing and letting the ball leave the tubing over the lip of a roulette wheel the ball can land on any of a plurality of numbers. The player who earns 100 points first is the winner. In order to speed the game, a slot on the roulette wheel may be marked 100, thus anyone who lands on that slot automatically is the winner, a sudden end to the game.

My invention can be understood in view of the accompanying figures.

Figure 1:
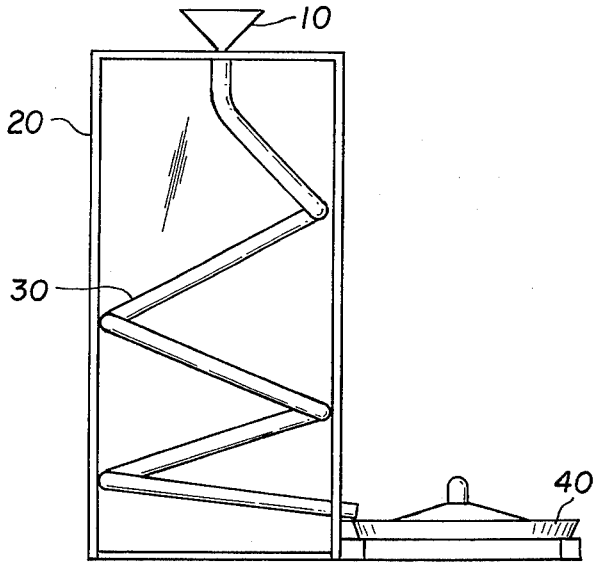
FIG. 1 shows a side view of the game.
Figure 2:
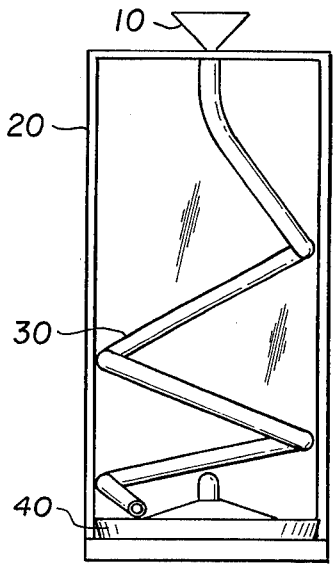
FIG. 2 shows a front view of the game.
Figure 3:
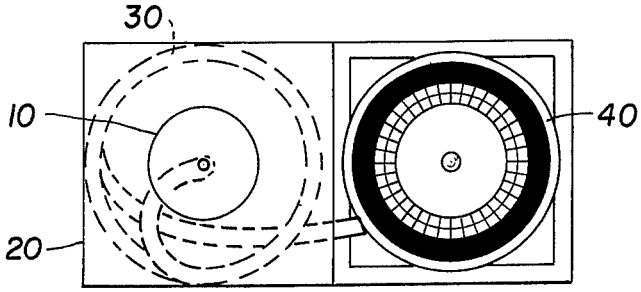
FIG. 3 is a top view of the game.

In FIGS. 1, 2, and 3, a funnel 10 is mounted on the top of a case 20 in which the narrow opening of the funnel is connected to a plastic tubing spiraled counterclockwise 30 and leaving the case over a roulette wheel 40, attached to the case 20.

Figure 4:
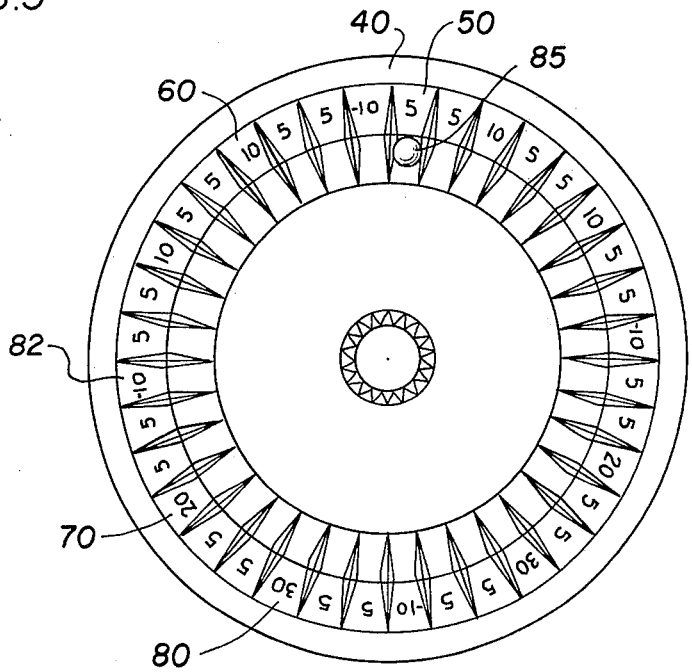
FIG. 4 is a view of the center of the roulette wheel showing the ball landed in a particular slot.

In FIG. 4, the normal face of the roulette wheel can be replaced by a wheel 40 with 24 marks of 5 50, four marks of 10 60, two marks of 20 70, two marks of 30 80, and four marks of −10 82. The steel ball 85 has landed on a 5 50.

Figure 5:
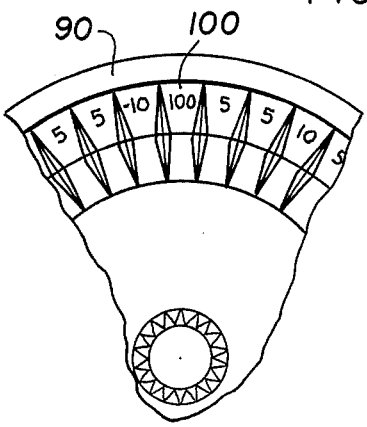
FIG. 5 is a view of a portion of an alternate roulette wheel face with a slot marked 100 shown.

In FIG. 5, if the roulette wheel is of the standard 37 slots, 90 the number 100 100 can be included to cause a sudden ending to the game when a player lands on the 100 slot 100 and immediately earns the 100 points needed to win the game.

Standard roulette wheels with standard markings can also be used.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A game using a spiral tube and a roulette wheel, comprising:

a case, a funnel mounted in the top of the case, a roulette wheel attached to an exterior lower side of the case, a tube attached to the bottom end of the funnel and mounted in the case, spirally descending through the case and leaving the case over the roulette wheel, and a ball, whereby the ball may be spiralled from the funnel to the roulette wheel, thereby earning a point value.

2. The roulette wheel of claim 1, wherein a slot of the roulette wheel is marked with the value 100, whereby a player having the ball land thereon may automatically win by achieving a winning score of 100 first.

3. The roulette wheel of claim 1, wherein the roulette wheel is marked with twenty four 5 marks, eight 10 marks, two 20 marks, and two 30 marks.

* * * * *